US006921250B2

(12) United States Patent
Boffelli

(10) Patent No.: US 6,921,250 B2
(45) Date of Patent: Jul. 26, 2005

(54) ENGINE COOLING FAN WITH ELECTROMAGNETIC CLUTCH

(75) Inventor: Pier Carlo Boffelli, Milan (IT)

(73) Assignee: Baruffaldi S.p.A., San Danato Milanese (IT)

( * ) Notice: Subject to any disclaimer, the term of this patent is extended or adjusted under 35 U.S.C. 154(b) by 0 days.

(21) Appl. No.: 10/634,686

(22) Filed: Aug. 5, 2003

(65) Prior Publication Data

US 2004/0025812 A1 Feb. 12, 2004

(51) Int. Cl.[7] ..... F04D 29/36
(52) U.S. Cl. ..... 416/155; 416/169 A; 416/205
(58) Field of Search ..... 415/123; 416/169 A, 416/169 R, 205, 207, 208, 155, 159; 192/69.42, 90, 84.31

(56) References Cited

U.S. PATENT DOCUMENTS 3,899,061 A * 8/1975 Krug ..... 192/84.31
3,924,585 A * 12/1975 Woods ..... 192/84.961
4,397,380 A * 8/1983 Yew ..... 192/84.51
5,687,823 A * 11/1997 Nakagawa et al. .... 192/84.961
6,109,871 A * 8/2000 Nelson et al. ..... 416/36

FOREIGN PATENT DOCUMENTS

| | | |
|---|---|---|
| EP | 1 002 940 | 5/2000 |
| EP | 1 130 233 | 9/2001 |
| GB | 1 147 266 | 4/1969 |

* cited by examiner

*Primary Examiner*—Ninh H. Nguyen
(74) *Attorney, Agent, or Firm*—Herbert Dubno

(57) ABSTRACT

Apparatus for conveying air to radiators of motor vehicles and the like having a fan (10) having a plurality of blades (12) each radially mounted its own coupling device (31) on a central body (11) and able to be rotationally actuated about its longitudinal axis by an actuator (41,42,43) depending on the quantity of air required for correct cooling of the fluid, the apparatus has a device (60,160,260,360,460) for engaging/disengaging the transmission of the rotational movement from the drive (23,21;321*a,*21;421*a,* 21) generating movement to the fan (10).

16 Claims, 4 Drawing Sheets

ENGINE COOLING FAN WITH ELECTROMAGNETIC CLUTCH

FIELD OF THE INVENTION

The present invention relates to an apparatus for conveying air to radiators of motor vehicles and the like, comprising a fan with directable blades and means for engaging/disengaging the transmission of the rotational movement of the fan.

BACKGROUND OF THE INVENTION

In motor vehicles there is a need to force air flow through the radiator in order to obtain more rapid dissipation of heat from the cooling liquid to the exterior. The forced air flow is obtained by causing the rotation of an apparatus which is normally mounted either directly on the drive shaft of on the shaft of the water pump or on a driven shaft carrying a pulley which is connected by a belt to the drive shaft.

An apparatus which allows continuous adjustment of the quantity of air forced onto the heat exchanger which cools the fluid is also known. This apparatus has a central body mounted on a rotating support and a plurality of blades radially mounted by means of associated coupling devices on said central body, said blades being rotatable about their respective longitudinal axes upon operation of movement actuating and transmission means forming part of the apparatus.

An example of such an apparatus is that for example described in EP 0,967,104.

Such apparatus can have the drawback that the blade-support assembly continues to rotate even when the angle of incidence of the blades is at a minimum, thus resulting in an undesirable drawing of power with an associated increase in the fuel consumption and constant noisiness, even when the climatic and operating conditions are such that the cooling fan need not be used.

OBJECT OF THE INVENTION

The object of the invention is to provide a ventilation apparatus for conveying the air cooling the cooling liquid in motor vehicles or the like, which allows continuous adjustment of the flow of forced air onto the heat exchanger containing the cooling liquid and which also allows interruption in operation of the said apparatus, when it is not required to force air onto the fluid for cooling thereof.

SUMMARY OF THE INVENTION

This object is achieved according to the present invention by an apparatus for conveying air to radiators of vehicles and the like, comprising a fan having a plurality of blades each radially mounted by means of its own coupling device on a central body and able to be rotationally actuated about its longitudinal axis by means of actuating means depending on the quantity of air required for correct cooling of the fluid, the apparatus comprising means for engaging/disengaging the transmission of the rotational movement from the means generating said movement to the fan.

BRIEF DESCRIPTION OF THE INVENTION

Figure 1:
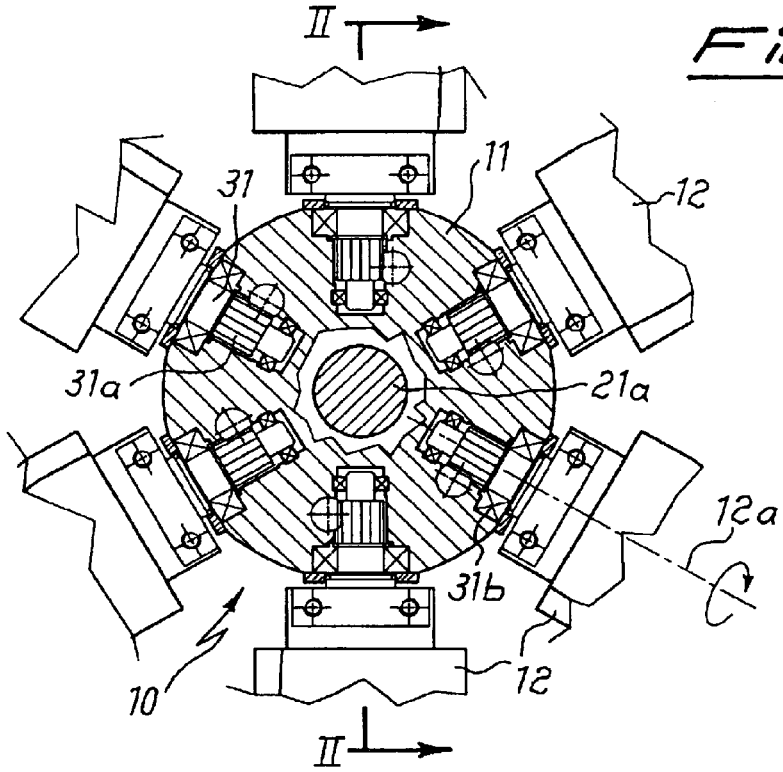
Figure 2A:
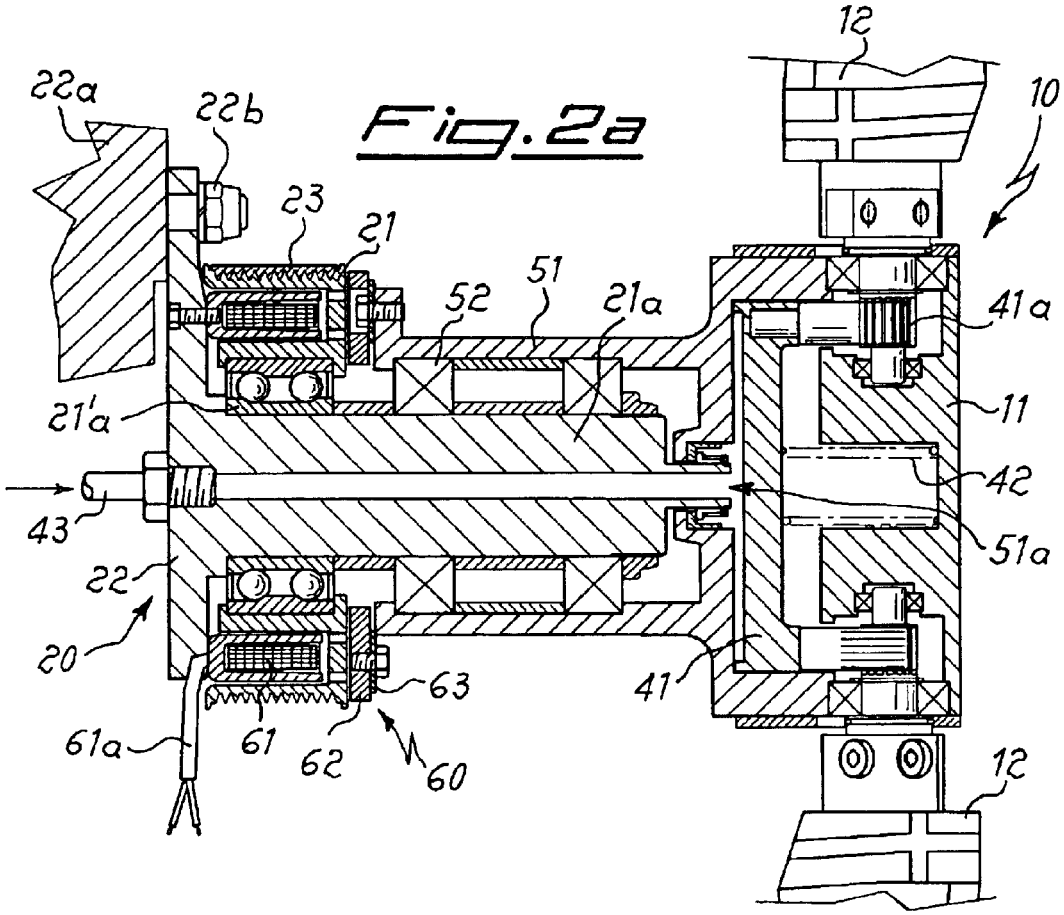
Figure 2B:
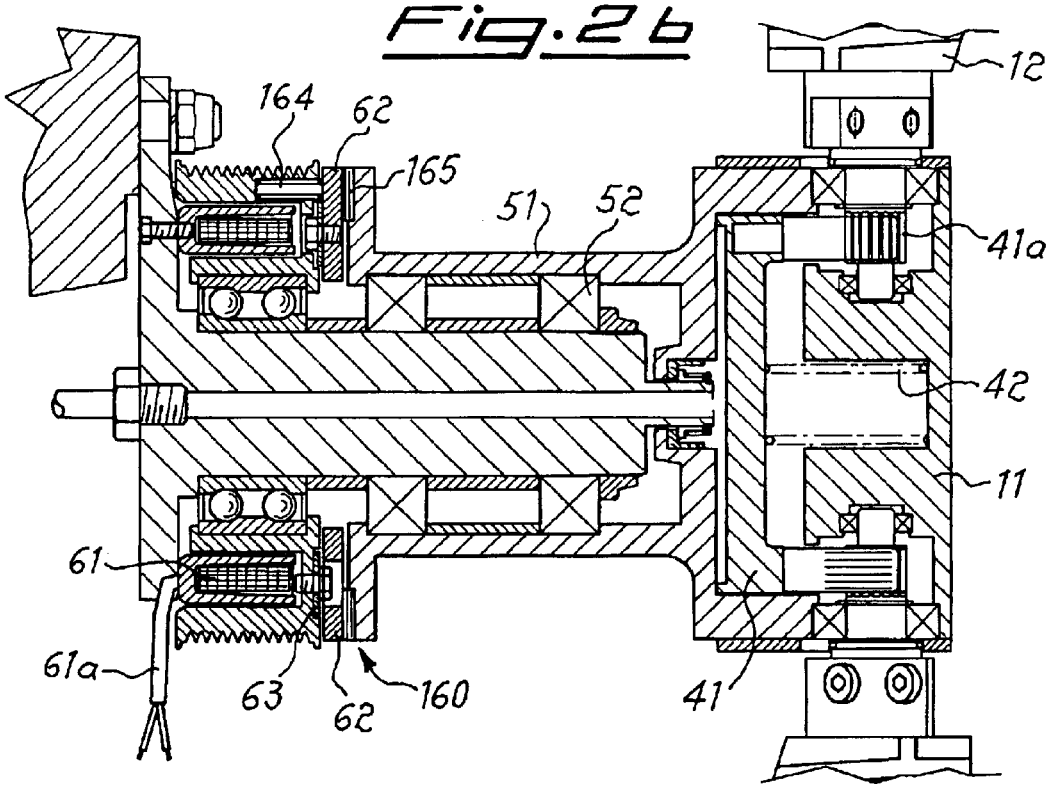
Figure 2C:
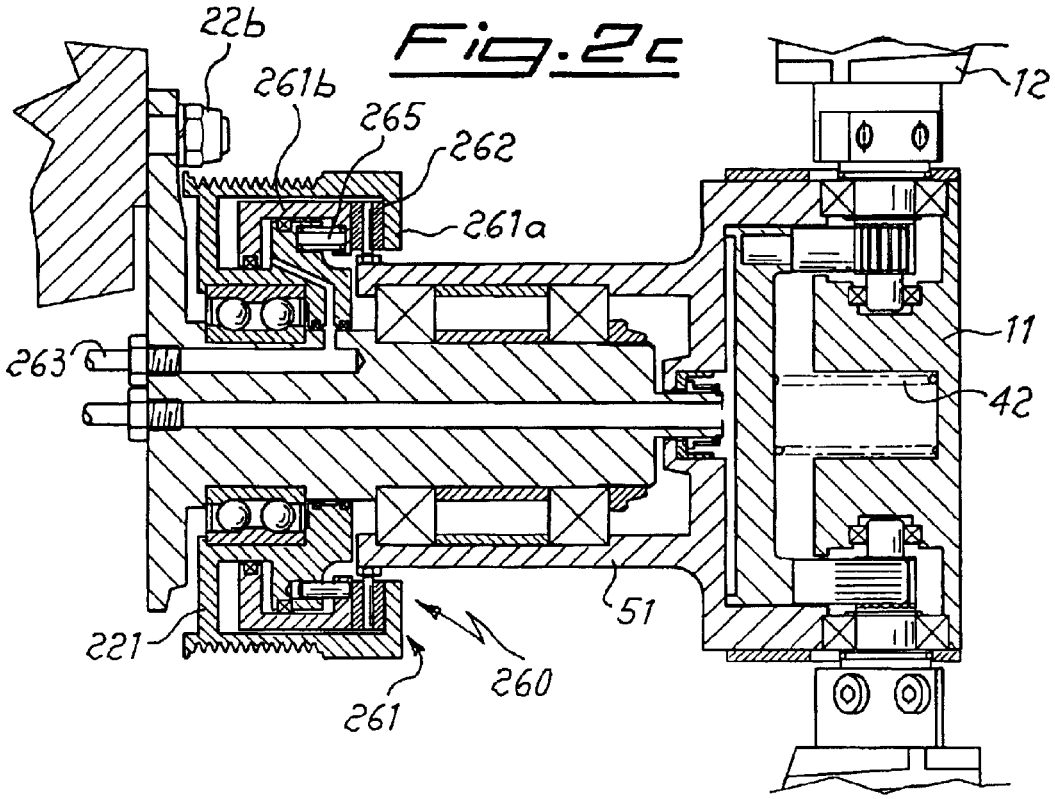
Figure 3C:
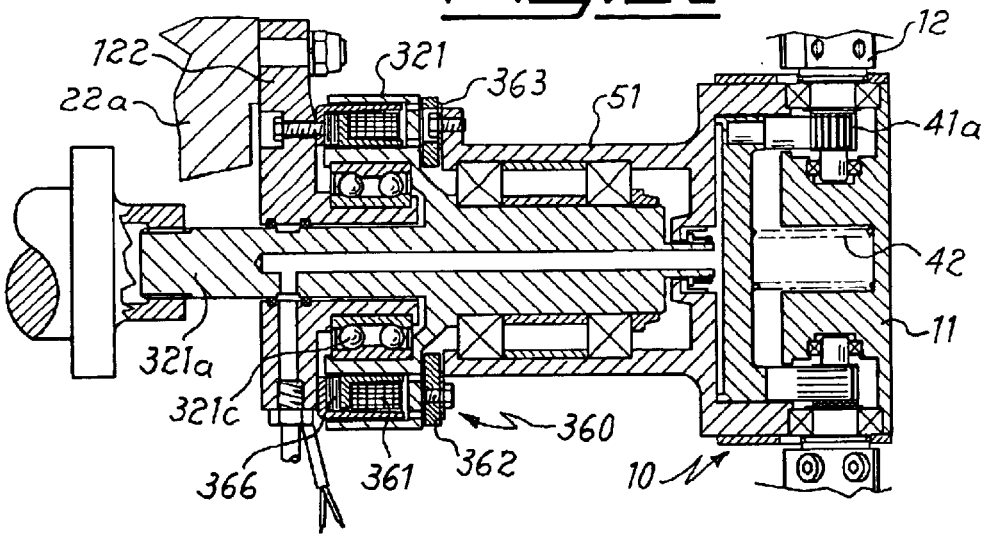
Figure 3B:
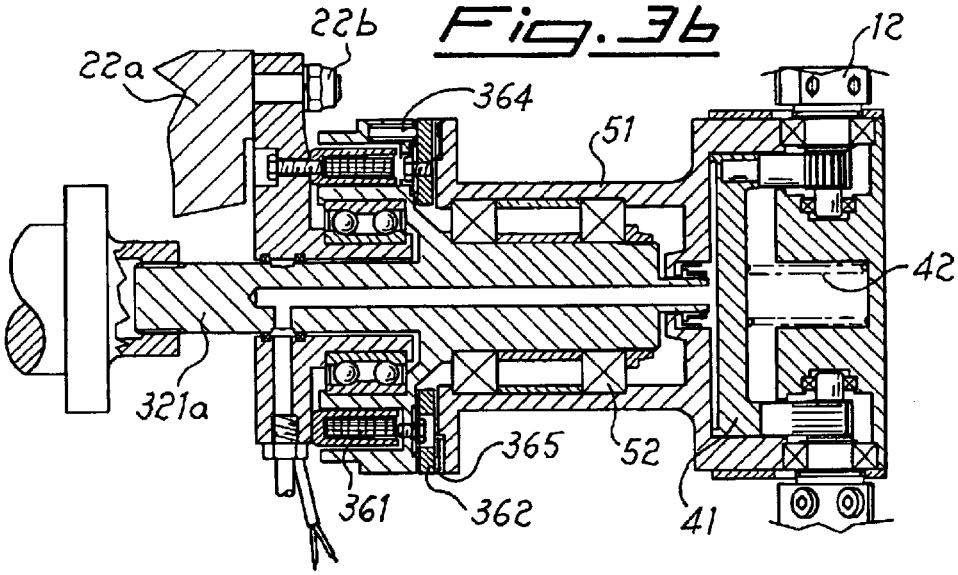
Figure 3A:
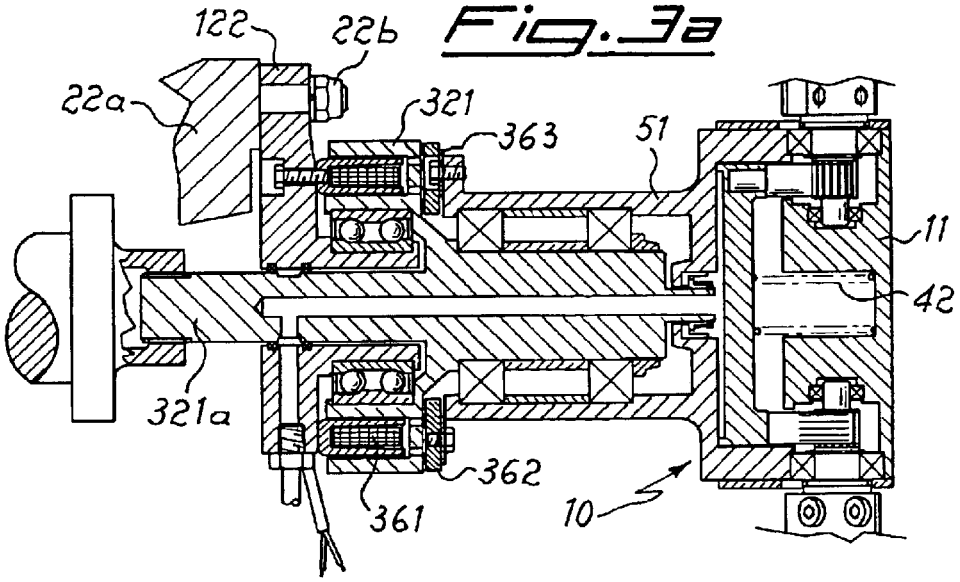
Figure 4A:
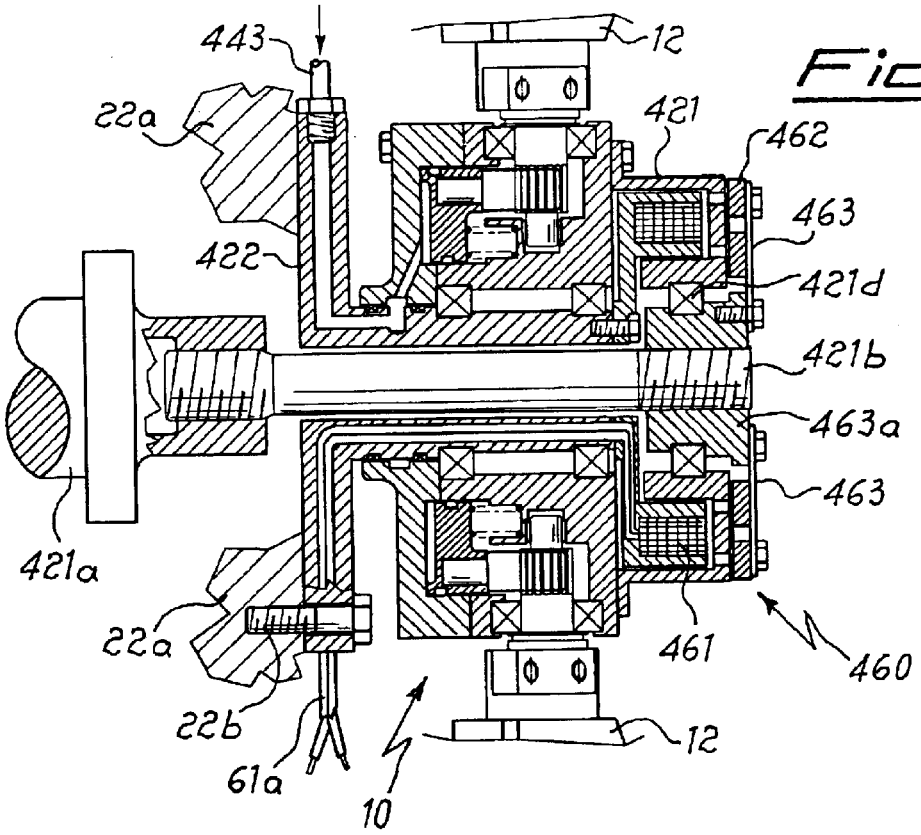
Figure 4B:
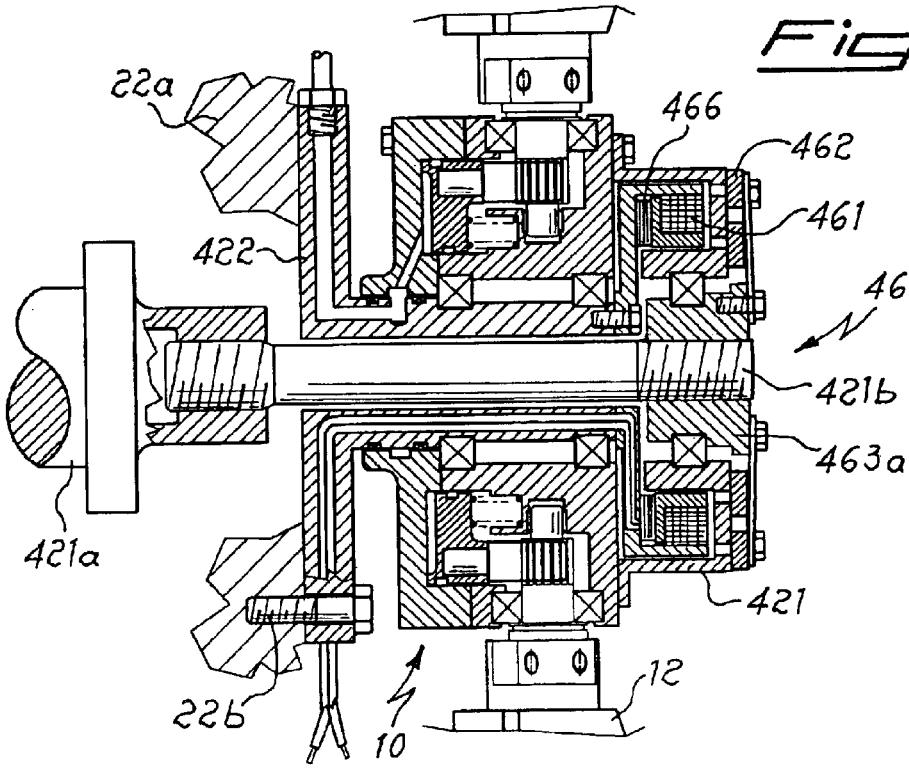

Further details may be obtained from the following description of several embodiments of the invention provided with reference to the accompanying drawing, in which:

FIG. 1 is a schematic cross-section along a plane transverse to the axis of the apparatus according to the present invention, illustrating the known blade directing devices;

FIG. 2*a* is a schematic cross-section along the line II—II in FIG. 1, illustrating a first embodiment of the apparatus according to the present invention;

FIG. 2*b* is a schematic cross-sectional view, similar to that of FIG. 2*a*, of a second embodiment of the apparatus according to the present invention;

FIG. 2*c* is a cross-sectional view, similar to that of FIG. 2*a*, of a third embodiment the apparatus according to the invention;

FIG. 3*a* is a cross-sectional view, similar to that of FIG. 2*a*, of a fourth embodiment of the apparatus according to the invention;

FIG. 3*b* is a cross-sectional view, similar to that of FIG. 3*a*, of a fifth embodiment of an apparatus according to the invention;

FIG. 3*c* is a cross-sectional view, similar to that of FIG. 3*a*, of a sixth embodiment of an apparatus according to the invention;

FIG. 4*a* is a cross-sectional view, similar to that of FIG. 2*a*, of a seventh embodiment of an apparatus according to the invention; and FIG. 4*b* is a cross-sectional view, similar to that of FIG. 4*a*, of an eighth embodiment of an apparatus according to the invention.

SPECIFIC DESCRIPTION

As illustrated in FIGS. 1 and 2*a*, the apparatus 10 for cooling the cooling liquid of motor vehicles and the like according to the invention is mounted on a supporting and movement transmission device 20 comprising a rotor 21, rotating on bearing 21*a* keyed onto a mounting block 22 which is integrally joined to the body 22*a* of the engine by means of bolts 22*b* or the like, which mounting block extends in the longitudinal direction with a fixed shaft 21*a* on which the apparatus 10 is mounted with the arrangement, in between, of respective bearings described below.

The rotor 21 is kept constantly rotating by means of a pulley 23 integral with the rotor itself and connected in a known manner to a shaft of the vehicle engine.

The apparatus 10 essentially consists of a central body 11 on which the blades 12 which cause the flow of the air from the outside towards the radiator (not shown) containing the cooling liquid are radially mounted.

In the embodiment shown, each blade 12 has an end inside the central body 11, consisting of a pivot pin 31, with cylindrical teeth 31*a*, which is radially mounted by means of bearings 31*b* on the body 11. In this way each blade 12, in addition to rotating with the fan 10 on the support 21*a*, is also able to rotate about its longitudinal axis 12*a*.

Each gearing 31*a* is in fact coupled to an actuating device consisting of an associated straight rack 41*a* integral with a coaxial disk 41 inserted inside a respective seat 51*a* of a sleeve 51 mounted on the shaft 21*a* by means of associated bearings 52 which allow the free rotation of the sleeve itself, and therefore the fan integral therewith, relative to the shaft 21*a*.

The disk 41, and therefore the rack 41*a*, is constantly pushed in the opposite direction to that of the blades 12 by resilient means, consisting by way of example of a coaxial spring 42, there being envisaged means 43, inside the fixed shaft 21*a*, for supplying a fluid under pressure, able to overcome the thrusting force of the spring 42 in order to cause advancing of the disk 41 and therefore rotation of the blades 12.

As can be seen, the blade actuating device is able to ensure the rotation, in a continuous manner, of all the blades simultaneously and in the same direction through a suitable angle, which is in each case defined according to operating requirements.

In order to cause stoppage of the fan independently of the direction of the blades, it is envisaged that the apparatus is provided with means for engaging/disengaging the transmission of the rotational movement from the means generating the said movement to the fan unit.

In greater detail said engaging/disengaging means consist (see FIG 2*a*) of an electromagnetic clutch 60 comprising:

an electromagnet 61, which is fixed to the support 22 and inserted in a corresponding seat of the rotor 21, the electromagnet being supplied with current by means of associated conductors 61*a* connected to the devices (not shown) for detecting and controlling the temperature; and an armature 62, which is integrally joined to the sleeve 51 of the fan 10 with the arrangement, in between, of a ring 63 having a high radial rigidity, but resiliently deformable in the axial direction so as to allow a corresponding axial movement of the said armature.

With this configuration it is envisaged that the electromagnet is normally de-energized and that fluid under pressure is not supplied to the disk 41; as a result the clutch is disengaged and the fan remains immobile with the disk 41 pushed by the spring 42 into a position corresponding to the maximum angle of the blades and therefore the maximum quantity of air which can be supplied to the radiator.

On the other hand, energization of the electromagnet 61 produces an electromagnetic field which, overcoming the resistance of the ring 63, recalls the armature 62 in the axial direction, connecting, by means of friction, the rotor 21 to the fan 10 which starts to rotate. According to requirements it may also be possible to adjust the angle of the blades 12 by supplying a suitable quantity of fluid under pressure to the duct 43.

In the embodiment according to FIG. 2*b* it is envisaged that the clutch 160 comprises resilient means 164 arranged parallel to the longitudinal axis of rotation—inside the rotor 161 in the example—which are able to push the armature 62 axially against elements 165 with a high coefficient of friction frontally integral with the sleeve 51.

In this case, the electromagnet is normally de-energized and no fluid under pressure is supplied to the duct 43 so that the springs 164 constantly keep the sleeve 51 coupled to the rotor 61 and the blades are rotated into the maximum angular position in order to ensure constant rotation of the fan 10 and supplying of the maximum quantity of air to the radiator, also in the case of interruption in the control current.

Energization of the electromagnet, on the other hand, produces a magnetic force of attraction which, overcoming the thrust of the springs 164, axially attracts the armature 62 which, being separated from the friction material 165, disengages the clutch, stopping rotation of the fan 10.

In the embodiment according to FIG. 2*c*, it is envisaged that the clutch 260 comprises an armature consisting of a disk 262 coaxially fixed to the sleeve 51 and that coupling is produced by jaws 261*a*, 261*b* of a gripper 261 able to close around said armature 262 upon operation of respective actuating means.

In greater detail, the jaw 261*a* is fixed and integral with the rotor 221, while the jaw 261*b* constitutes the piston of a cylinder and is movable translationwise in an axial direction and in both senses upon actuation, respectively, of a spring 264, which pushes towards the fan, and a fluid under pressure which is supplied by means of associated ducts 243 to the said cylinder and which pushes in the opposite direction.

In this configuration the spring 264 constantly keeps the jaw 261*b* pushed, resulting in closure of the gripper 261 around the armature 262 and therefore the rotation of the fan 10.

In order to interrupt rotation of the fan 10, fluid under pressure is supplied to the cylinder, resulting in the axial displacement of the jaw 261*b*, against the thrusting action of the spring 264, which causes opening of the gripper 261 with consequent disengagement of the sleeve 51 and stoppage of the fan 10.

In the embodiments illustrated in FIGS. 3*a*, 3*b*, 3*c* it is envisaged that the longitudinal support 321*a* consists of a shaft coaxially inserted inside the fixed mounting block 122 and rotating with respect to the latter by means of respective bearings 321*c*.

The rotating shaft 321*a* supports integrally the rotor 321. As illustrated in FIGS. 3*a* and 3*b*, the engaging/disengaging means are substantially similar to the means already described in connection with FIGS. 2*a*, 2*b* and therefore not further described in detail, while the embodiment according to FIG. 3*c* envisages that permanent magnets 366 are arranged inside the clutch 360 behind the electromagnet 361, these magnets keeping the armature 362 constantly coupled to the rotor 321 and therefore the sleeve 51 and the fan 10 always rotating.

In order to stop rotation of the fan 10, the electromagnet 361 is energized, resulting in the generation of an electromagnet field which opposes the force of attraction of the permanent magnets 346, resulting in recall of the armature 362 by the resilient ring 363 with the consequent separation of the sleeve 51 from the rotor 221.

FIGS. 4*a*, 4*b* show two further embodiments of the apparatus according to the invention wherein the fan 10 is mounted in a central position between the fixed mounting block 422 with means for generating the movement, on one side, and the engaging/disengaging means 460, on the other side, so that the assembly is more compact in the axial direction and therefore subject to smaller forces in the direction transverse to the axis of rotation.

In greater detail (FIG. 4*a*), the support 422 supports the fan 10 with associated blades 12 , adjustment of the angle of which is obtained by means of supplying of a fluid under pressure to channels 443 in a similar manner to that described in connection with FIG. 2*a* and therefore not further specified.

On the opposite side to that of the mounting block 422, the fan 10 supports, integral therewith, the rotor 421 which is coaxially mounted on the race of a bearing 421*d*, the other race of which is joined to the armature 462 in turn integral with a spring plate 463 constrained to a bush 463*a* keyed onto the free end 421*b* of the actuating shaft 421*a*. With this configuration, the shaft 421*a* ensures the constant rotation of the armature 462 which functions in this case as a rotor and which is coupled to the rotor 421 only when the electromagnetic 461 is energized. This means that, in order to ensure ventilation, it is necessary to keep the electromagnet 461 constantly energized and in the event of interruption of the power the ventilation would be halted. In order to overcome this drawback it is possible to use the configuration according to FIG 4*b* which envisages the insertion of a permanent magnet 466 ahead of the electromagnet 461 so that the armature 462 is constantly coupled to the rotor 421. In this case energization of the electromagnet produces an electromagnetic field which neutralizes the magnetic field of the permanent magnet 466, resulting in recall of the armature 462 by the spring plate 463 and therefore disengagement of the rotor 421 with consequent stoppage of the fan 10.

The person skilled in the art may interchange the constructional solutions described and illustrated, without thereby departing from the scope of the claims which follow.

What is claimed is:

1. An apparatus with directable blades for displacing air to a radiator of a motor vehicle, comprising:

a fan having a plurality of blades each radially mounted a respective coupling device on a central body and able to be rotationally actuated about a respective longitudinal axis of the blade depending on a quantity of air required for cooling in said radiator; and an electromagnetic clutch for engaging/disengaging transmission of the rotational movement from a source of rotational movement to said fan.

2. The apparatus according to claim 1 wherein said electromagnetic clutch consists of a fixed electromagnet, a rotor integral with the source of the rotational movement, and an armature integral with an element supporting the fan and movable axially with respect to said support.

3. The apparatus according to claim 2, further comprising resilient means able to exert a pushing farce in an axial direction against the armature in order to keep it constantly coupled to the rotor are associated with said electromagnetic clutch.

4. The apparatus according to claim 2 wherein said electromagnetic clutch has permanent magnets able to keep the armature constantly coupled to the rotor.

5. The apparatus according to claim 2 wherein said electromagnetic clutch is normally not energized.

6. The apparatus according to claim 2 wherein said element supporting said fan is a support mounted on a support shaft with bearings in between.

7. The apparatus according to claim 6 wherein said support shaft is fixed.

8. The apparatus according to claim 7 wherein the rotor receives the rotational movement from suitable external transmission means.

9. The apparatus according to claim 6, said support shaft is movable rotationally.

10. The apparatus according to claim 9 wherein the rotor receives movement from the support shaft with which it is integral.

11. The apparatus according to claim 9 wherein the armature is integral with the shaft and the rotor is integral with the fan.

12. The apparatus according to claim 1 wherein that said electromagnetic clutch is normally energized.

13. The apparatus according to claim 1 wherein the fan is arranged after the engaging/disengaging means.

14. The apparatus according to claim 1 wherein the fan is arranged ahead of the engaging/disengaging means.

15. An apparatus for displacing air to a radiator of a motor vehicle, comprising:

a fan having a plurality of blades each radially mounted on a respective longitudinal axis by a respective coupling device on a central body;

an actuator acting upon said coupling devices for rotating said blades about the respective longitudinal axes depending upon the quantity of air required for cooling in said radiator;

a rotor driven by an engine of the motor vehicle;

an element supporting said fan and rotatable about an axis of rotation of said rotor; and a gripper device able to close around an armature rotationally integral with said element for engaging/disengaging transmission of rotational movement from said rotor to said element and said fan.

16. The apparatus defined in claim 15 wherein said armature projects radially from said element and said gripper device has two jaws juxtaposed with opposite sides of said armature, one of said jaws being fixed to said rotor, the other of said jaws being mounted for translation in an axial direction on said element toward and away from said armature by actuation of corresponding actuation means.

* * * * *